United States Patent [19]

Shurgan

[11] Patent Number: 4,649,319

[45] Date of Patent: Mar. 10, 1987

[54] GAS DISCHARGE LAMP STARTER

[75] Inventor: Joel Shurgan, Westwood, N.J.

[73] Assignee: Duro-Test Corporation, N.J.

[21] Appl. No.: 657,414

[22] Filed: Oct. 3, 1984

[51] Int. Cl.[4] ..... H05B 39/00

[52] U.S. Cl. ..... 315/99; 315/101; 315/103; 315/105; 315/345

[58] Field of Search ..... 315/101, 103, 345, 98, 315/99, 105

[56] References Cited

U.S. PATENT DOCUMENTS

| | | | |
|---|---|---|---|
| 2,512,280 | 6/1950 | Lemmers | 315/349 |
| 3,705,329 | 12/1972 | Vogeli | 315/103 |
| 4,015,167 | 3/1977 | Samuels | 315/101 |
| 4,410,836 | 10/1983 | Roche | 315/101 |
| 4,460,848 | 7/1984 | Fahnrich | 315/101 |
| 4,494,041 | 1/1985 | Roche | 315/101 |

FOREIGN PATENT DOCUMENTS

| | | | |
|---|---|---|---|
| 2103033 | 2/1983 | United Kingdom | 315/101 |

*Primary Examiner*—Harold Dixon
*Attorney, Agent, or Firm*—Darby & Darby

[57] ABSTRACT

A starter circuit for use with a fluorescent lamp includes an inductor coupled in series with the lamp electrodes and a semiconductor bilateral trigger, such as a Sidac, connected between the lamp electrodes. The semiconductor bilateral switch is selected to conduct electricity at a value below the instantaneous peak voltage applied and to cease conduction at a level above the operating voltage of the lamp. When the voltage reaches the predetermined level at which the semiconductor switch turns on, current is conducted through the electrode and the bilateral trigger. When the bilateral switch turns off, a large voltage pulse is generated in the inductor which voltage pulse appears at one of the lamp electrodes. A voltage potential is therefore set up across the electrodes to the lamp fixture which is grounded ionizing ionizable material, for example, mercury, within the lamp. The ionization of the material in the vicinity of the electrode permits the lamp to start, thus, the voltage appearing across the bilateral trigger falls below the level needed to trigger the switch on. The bilateral trigger has no further effect on lamp operation until the lamp is restarted.

3 Claims, 4 Drawing Figures

GAS DISCHARGE LAMP STARTER

BACKGROUND OF THE INVENTION

1. Field of the Invention

This invention relates to gas discharge lamp starters and more particularly to a solid state fluorescent lamp starter.

2. Description of the Prior Art

Fluorescent lamps are well-known in the art and are used for a variety of types of lighting installations. Such lamps are characterized as low pressure discharge lamps and include an elongated envelope whose interior wall is coated with a phosphor such as calcium halophosphate, zinc silicate or calcium tungstate, and an electrode structure at each end of the envelope. The envelope also contains a quantity of an ionizable material such as mercury, and a fill gas at low pressure, generally in the range of one to five mm. Hg. The fill gas may be a single gas or a mix of gases such as argon, krypton and neon.

In pre-heat type fluorescent lamps, the electrode at each end of the envelope is an electric filament. Lamp circuitry is utilized which provides a small current through the electrodes which in turn heats the filaments.

The electrode filament is usually of coiled tungsten wire having an emissive coating such as barium oxide that produces electrons when heated above 800 degrees C.°. The emitted electrons accelerated by the electric field in the vicinity of the cathode electrode, bombard the vaporized mercury in the vicinity of that electrode.

A voltage, supplied by a ballast across the lamp, from the electrode at one end of the lamp to the electrode at the other end of the lamp further accelerates the free electrons, ionizing additional mercury atoms. As a result of this ionization and subsequent recombination of ions and electrons, ultraviolet radiation is produced. The phosphor on the wall of the lamp generates visible radiation in response to the impinging ultraviolet radiation.

Conventional flourescent lamp starters provide a source of heating current to the filaments by connecting the two filaments, one at each end of the lamp, in series through a switching device which opens after a predetermined time interval when the coils have been heated to a proper temperature for electron emmission.

Prior art starters have been complex and often expensive to manufacture. They may include, a glow bottle and capacitor, or may be constructed as a thermal switch. Some more recent devices have been constructed with numerous solid components on a printed circuit board.

The glow bottle device is essentially a combination of a neon lamp and a bimetallic contact wired across the neon lamp electrodes. When the bimetallic contact is cool, the contacts remain open and the neon lamp can generate light and heat. Upon application of current to the starter circuit, the neon lamp portion of the glow bottle device begins to glow and eventually generates enough heat to cause the bimetallic contacts to come together shorting out the neon lamp. This allows a high enough current flow to heat up the cathodes. Since the neon lamp is shorted, it ceases to glow and generate heat thus allowing the bimetallic contacts to cool. After the bimetallic contacts have cooled sufficiently, they open and interrupt the circuit. Upon the opening of the circuit and in accordance with Lenz's law, an inductive voltage spike is generated by the inductor.

The inductive spike can function in one of two ways. First, if it is very large it can jump across both electrodes in the fluorescent lamp and cause ionization of the gas within the envelope which will then lead to starting of the lamp.

The second mode of operation occurs if a ground plane, usually the lamp fixture, is located sufficiently close to the lamp. Upon application of the large voltage pulse, atoms of gas within the envelope near the electrode coupled to the choke are ionized. This ionization eventually permits the lamp to start. In some instances, repeated cycling is necessary to sufficiently ionize the mercury in the vicinity of the electrode.

One disadvantage of the above describe prior art starters is that unrealiable mechanical devices are used which are bulky in nature and relatively expensive to manufacture. Furthermore, due to the inductive reactance of the choke, in order to develop a sufficient pulse the bimetallic contacts should open on a portion of high flow of the sinusoidal input current since the voltage in an inductor is equal to $-Ldi/dt$, where L is the inductance, and di/dt represents the current flow over time. The operation of the glow bottle device, however, is not synchronized with commonly used sinusoidal input current and therefore several starting attempts are often needed before the lamp lights. This leads to the familiar flickering of fluorescent lamps before they light.

Various solid state devices have been proposed for starting fluorescent lamps. They, however, have been multi-component devices and physically at least as large as a conventional glow-bottle starter.

SUMMARY

The starter circuit for a pre-heat type fluorescent lamp having first and second electrodes disposed at opposite of the lamp and includes an inductor wired in series with the first electrode in the fluorescent lamp. A bilateral trigger device is coupled between the first and second lamp electrodes. The second electrode is in turn coupled to the return of the line voltage.

It is therefore an object of this invention to provide a reliable starter circuit for a discharge lamp.

It is a further object of the invention to provide a starter which is compact.

It is yet another object to provide an inexpensive starting mechanism.

It is still a further object to provide a starter circuit which will start reliably and not provide visible flickering.

It is yet another object to provide a solid state starter circuit.

These and other objects and advantages of the invention become more apparent upon reference to the annexed specification and drawings.

DETAILED DESCRIPTION OF THE PREFERRED EMBODIMENTS

Figure 1:
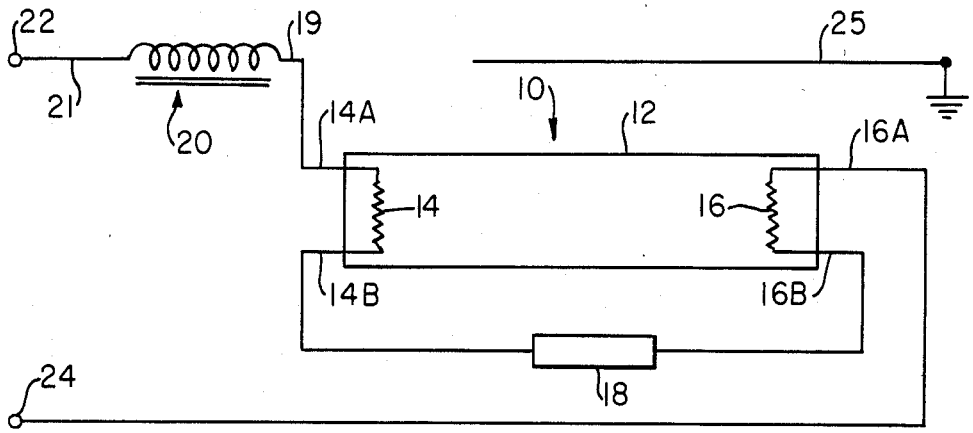
FIG. 1 is a schematic diagram of a lamp starter in accordance with the present invention.

Referring to FIG. 1, lamp 10 is a conventional fluorescent lamp of the pre-heat type, including a glass envelope enclosing a fill gas and mercury which is to be vaporized and ionized. Located at either end of the generally elongated cylindrical tube of envelope 12 are electrodes 14 and 16 which are coils of resistance wire that heat up and emits electrons upon application of electric current. The electron emission ionizes the mercury in the vicinity of the electrodes. As the electrons recombine with the mercury ions, various electron transistions take place which results in the emmission of ultraviolet light. The ultraviolet light impinges upon the wall of the lamp 12 which includes a phospor coating. The phosphor coating emits visible light a a result of electronic interaction with the ultraviolet light.

A bilateral trigger device 18 is coupled in parallel with lamp 10 between electrodes 14 and 16 at their ends 14B and 16B respectively. A ballast choke 20, which is an inductor, is coupled at an output end 20 to the end 14A of electrode 14 not coupled to the bilateral trigger device 18. The other end 21 of choke 20 is coupled to a terminal of the AC line voltage at terminal 22. The remaining uncoupled end 16A of electrode 16 is coupled to the other AC line voltage terminal 24. The lamp is located proximate to structure 25 at ground potential. In conventional fixtures structure 25 is the lamp fixture, i.e. a metal plate.

Figure 2:
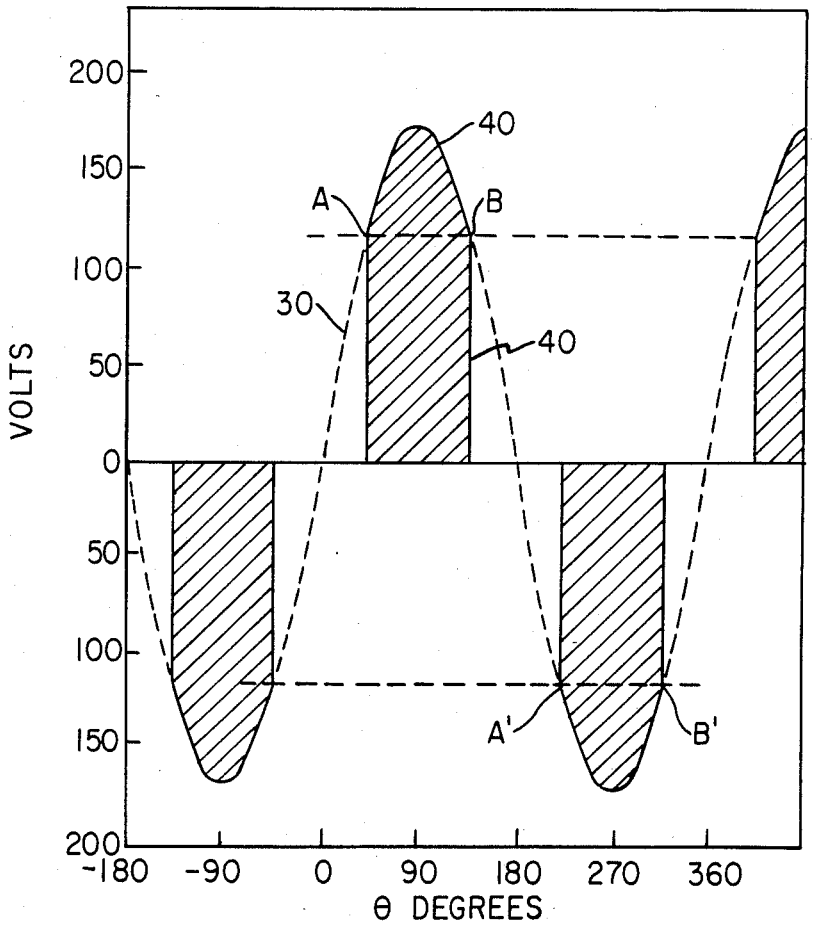
FIG. 2 is a graph useful for explaining the operation of a bilateral switch.

Bilateral trigger device 18 is a solid-state device that conducts current equally well in either direction of current flow once a given voltage is reached. Referring to FIG. 2 no current flows in either half cycle until a voltage, called the breakover voltage is reached at an electrical angle $\theta$. Current continues to flow after point A until the voltage falls below the value at point B when conduction ceases. On the next half cycle, the current flow is the same in the reverse direction, that is, current does not begin to flow until point A' is reached and then ceases to flow at point B'. Once the breakover voltage is reached, the device acts as a short circuit with a very small voltage drop the voltage waveform is shown at 40.

One suitable bilateral trigger device that is particularly compact is a "Sidac" manufactured by Motorola Semiconductor Products, Inc., P.0. Box 20912, Phoenix, Ariz. 85036. The sidac is a two terminal bilateral trigger device. When the voltage applied across the Sidac in either direction reaches a predetermined breakover voltage the sidac switches through a negative resistive region from a blocking state to a low voltage on state. Conduction continues as in an SCR, that is, until the current flowing through the sidac is interrupted or drops below a "holding" current level.

Figure 3:
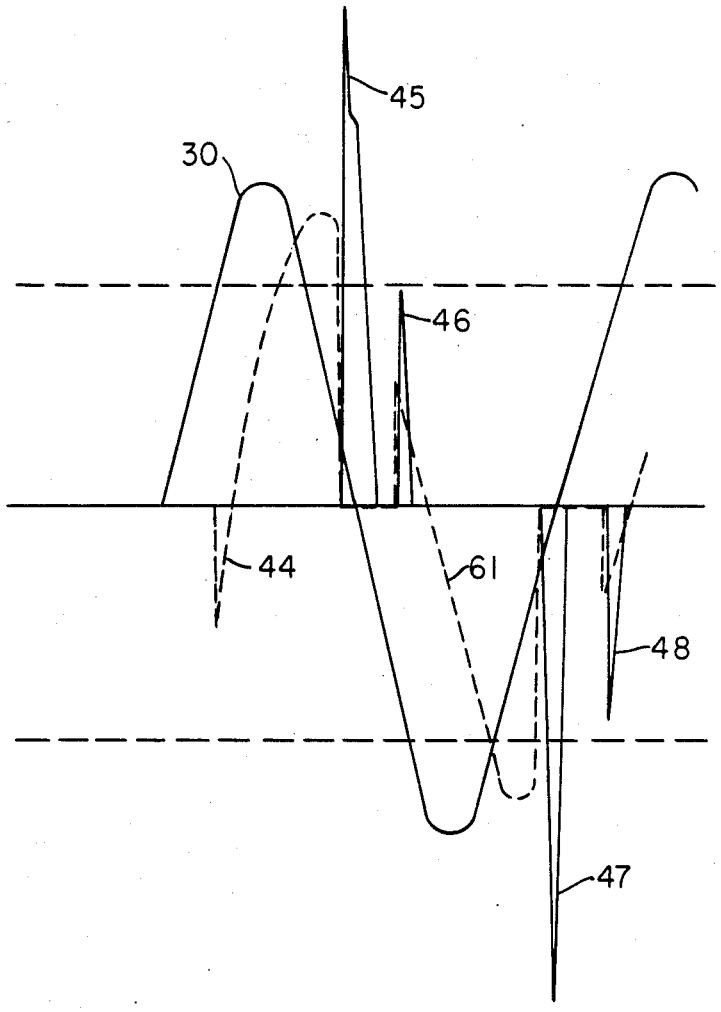
FIGS. 3 and 4 are waveforms useful for explaining the operation of the present invention.

The sidac's breakover voltage is generally not symetrical with respect to the on and off voltage. Generally, the off voltage will be dependent upon the current draw as well as the characteristics of the device. In FIGS. 2 and 3 the device is shown as being symmetrical for purposes of explanation. One particular sidac which has been found to be useful is the Motorola mark MK1B115 unit which has a nominal break over voltage of 115 volts.

Figure 4:
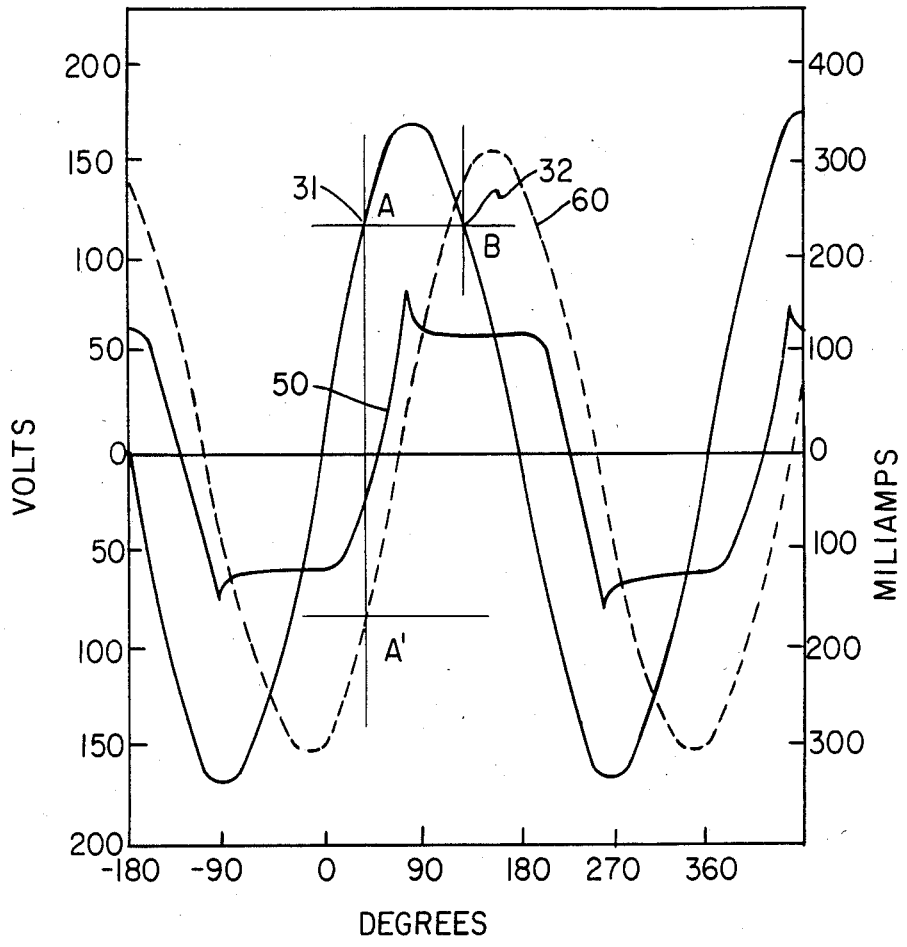

Referring to FIG. 4, in operation, current begins to flow in the electrode/sidac/electrode circuit upon the application of line voltages indicated at 31. The current continues to flow until point 32 is reached when the sidac turns off. Compared to a conventional starter, heating of the electrode is therefore reduced. More importantly, since the instantaneous current drops very rapidly to zero, a large transient voltage on the order of fifteen hundred volts is produced across the winding of choke 20. This large transient voltage is in the same direction as the instantaneous line voltage (that is, it opposes the voltage drop) since the voltage is falling as shown at 45 in FIG. 3.

As shown at 47, an additional negative going pulse occurs when sidac 18 opens or when the line voltage becomes smaller than the breakover voltage during the negative half cycle.

Subsidiary pulses occur as shown at 44, 46, and 48. Due to the inductive reactance of choke 20, current lags the voltage in the circuit as shown at 60 in FIG. 4 and 61 in FIG. 3. Thus, a smaller spike occurs, for example, at pulse 46, when the current stops, which occurs after the voltage has been cut off by sidac 18.

Electrode 14 coupled to the choke 20 is thus exposed for a brief instant to a high voltage on the order of 1500 volts relative to the ground 25 of the system. A small current, typically less than 500 microamperes, flows from the lamp electrode charging the capacitance existing between the electrode and the fixture. As is known in the art in standard practice fluorescent lamp fixtures are well grounded to permit this type of starting. This current flow provides some ionization of the mercury vapor in the region of the electrode 14. If this ionization is not sufficient to start the lamp, the cycle continues until the lamp starts since, the ionization is cumulative. Eventually enough mercury vapor will be ionized and the ionization will cascade down the lamp to permit lighting of the lamp.

Unlike conventional starters, the present invention cuts off current flow in the choke at times of high di/dt. The amplitude of the voltage starting pulse is the product of the inductance and di/dt. If the breakover voltage of the sidac is selected to be located at a portion of the line current waveform having a high slope, the pulse generated by the choke 20 is assured of having a high voltage amplitude. Consequently, a high amplitude pulse is reproduced each half cycle. As explained previously, this will insure flickerless lamp starting.

When the lamp starts, there is a voltage drop across the lamp and consequently across the sidac. The general shape and magnitude of the lamp voltage is as shown by waveform 50. Since the peak voltage of the lamp is below the breakover point, the bilateral trigger 18 does not conduct any more and the lamp remains normally lit.

In one specific example of the invention, a lamp rated at 80 volts and 220 mA lamp current was used with a Motorola MK1V115 sidac having a 115 volt breakover voltage. A nominal line voltage of 120 volts was applied having an instantaneous peak voltage of 169.7 volts. Choke 20 had an impedance of 50 ohms and the electrode filaments 14 and 16 together had a series resistance of 50 ohms. Heating current flowing to the electrode 14 and 16 lags the applied voltage by approximately 80 degrees as shown at 60 in FIG. 4 in the case where the sidac has been short circuited. Using the above-mentioned lamp at a nominal line voltage of 120 volts results in a current of approximately 240 mA. RMS.

While the present invention has been described for use with fluorescent lamps, other low pressure lamps having a ground plane near the electrodes may be used.

Additionally, high pressure discharge lamps may also be beneficially used with the present invention if they also satisfy the requirement of having a ground in close proximity to the lamp electrodes.

Devices other than sidacs can be used such as thyristors. These devices however, generally require external triggering produced from, for example a trigger diode coupled to the AC line. Thus more complex circuitry is required.

I claim:

1. A device for starting a discharge lamp having first and second filament electrodes at one end and third and fourth electrodes at another end mounted in a sealed envelope adapted to be located proximate to an electrical ground, said lamp being operated at a predetermined operating voltage, comprising:

first and second terminals adapted to receive alternating current voltage, said fourth electrode directly connected to said second terminal;

a ballast choke directly connected between said first electrode and said first terminal; and a two terminal having a pair of terminals directly connected between said second electrode and said third electrode, for conducting current when the instantaneous value of said AC voltage exceeds a first value more than said lamp operation voltage, and having a breakover voltage characteristic selected to cause it to cease to conduct current when said instantaneous AC voltage falls below a second value at a time when the current flowing through said choke is rapidly changing in amplitude, for generating a relatively high amplitude pulse in each half-cycle of said alternating current voltage, thereby providing flickerless starting of said lamp, whereby once the lamp is lit, the voltage drop across said lamp is below the breakover voltage of said semiconductor bilateral switch, maintaining the latter non-conductive.

2. The starter according to claim 1 wherein said lamp is a low pressure discharge lamp.

3. The starter according to claim 2 wherein said low pressure discharge lamp is a fluorescent lamp of the pre-heat type and said electrodes comprise filaments adapted to emit electrons upon the receipt of electric current thereby.

* * * * *